US007966776B2

(12) United States Patent
Cook

(10) Patent No.: US 7,966,776 B2
(45) Date of Patent: Jun. 28, 2011

(54) TEXTURED WINDOW WELL

(76) Inventor: Vaughn A. Cook, Mapleton, UT (US)

( * ) Notice: Subject to any disclaimer, the term of this patent is extended or adjusted under 35 U.S.C. 154(b) by 0 days.

(21) Appl. No.: 11/122,264

(22) Filed: May 3, 2005

(65) Prior Publication Data

US 2005/0252103 A1 Nov. 17, 2005

Related U.S. Application Data

(60) Provisional application No. 60/567,255, filed on May 3, 2004.

(51) Int. Cl.
*E04F 17/06* (2006.01)

(52) U.S. Cl. ..... 52/107; 52/309.1

(58) Field of Classification Search ..... 52/107, 52/309.2, 309.1; 428/167, 172, 187
See application file for complete search history.

(56) References Cited

U.S. PATENT DOCUMENTS 3,593,354 A * 7/1971 Carter ..... 114/357
4,226,062 A * 10/1980 Doane ..... 52/169.6
4,704,828 A 11/1987 Kemp
4,876,833 A 10/1989 Gefroh et al.
5,107,640 A 4/1992 Gefroh et al.
5,657,587 A 8/1997 Gefroh
5,881,503 A 3/1999 Eichelberger
D466,221 S 11/2002 Oakley
6,484,455 B1 11/2002 Poole
D472,978 S 4/2003 Oakley
D486,582 S 2/2004 Hawkes
6,713,009 B2 3/2004 Van Gilst
D497,013 S 10/2004 Hughes
6,880,300 B2 * 4/2005 Hawkes ..... 52/107
6,915,612 B2 7/2005 Oakley
2002/0106504 A1 * 8/2002 Stott ..... 428/315.9
2003/0042074 A1 3/2003 Van Gilst
2003/0167705 A1 9/2003 Oakley
2003/0182877 A1 10/2003 Worth
2004/0035063 A1 2/2004 Bryant et al.
2004/0083661 A1 5/2004 Hawkes
2004/0098929 A1 5/2004 Kim et al.

OTHER PUBLICATIONS

Wellcraft Model 2067 Modular Egress Window Well (downloaded from wellcraftwells.com Dec. 16, 2003 archived webpage).*

* cited by examiner

*Primary Examiner* — Jeanette E Chapman
*Assistant Examiner* — Daniel Kenny
(74) *Attorney, Agent, or Firm* — Workman Nydegger

(57) ABSTRACT

A window well structure adapted to be disposed at least partially below grade and adjacent a window in a foundation. The window well structure includes a main body having a center wall portion and two opposing side wall portions. The window well structure may also include a decorative design on its front surface and a plurality of support ribs to reinforce the main body. Each of the support ribs may include a core comprised of a filler material, such as foam, and may be comprised of a composite material.

29 Claims, 7 Drawing Sheets

TEXTURED WINDOW WELL

CROSS-REFERENCE TO RELATED APPLICATIONS

This application claims the benefit of U.S. Provisional Application No. 60/567,255 filed May 3, 2004, which is hereby incorporated by reference herein in its entirety, including but not limited to those portions that specifically appear hereinafter, the incorporation by reference being made with the following exception: In the event that any portion of the above-referenced provisional application is inconsistent with this application, this application supercedes said above-referenced provisional application.

STATEMENT REGARDING FEDERALLY SPONSORED RESEARCH OR DEVELOPMENT

Not Applicable.

BACKGROUND

1. The Field of the Invention

The present disclosure relates generally to window well structures.

2. Description of Related Art

Below grade windows often require the use of window wells to allow light and fresh air to enter into basements of homes and buildings. The window wells also provide escape routes for persons in the event of an emergency. In fact, building codes often require the presence of window wells for emergency exits. Although window wells have been used for over 100 years, often little thought has gone into their attractiveness. Most window well designs have focused primarily on the functional aspects of the window well.

Previously available window wells include window wells formed from metal. These metal window wells often included corrugation to add strength to the window well. These metal window wells are generally U-shaped and include flanges to mount the window well to the foundation. For example, U.S. Pat. No. 4,704,828 (granted Nov. 10, 1987 to Kemp) discloses a window well structure comprising multiple superimposed U-shaped sections formed from sheet metal.

Other window well designs include decorative features. For example, U.S. Pat. No. 5,881,503 (granted Mar. 16, 1999 to Eichelberger) discloses a decorative window well having a plurality of planters coupled to the window well for supporting plants.

U.S. Pat. No. 6,484,455 (granted Nov. 26, 2002 to Poole) discloses a rigid window well structure formed from either a composite material or metal, that includes a step extending between a front wall and a side wall. The presence of the step between the front wall and the side wall purportedly increases the rigidity of the window well.

U.S. Patent Application Publication No. US2003/0042074 (published Mar. 6, 2003 to Van Gilst) discloses a window well constructed using a rotomold process. This window well includes a thermoplastic wall and an integrated ladder in the wall of the window well. Other designs for window wells are shown in U.S. Pat. No. D472,978 (granted Apr. 8, 2003 to Oakley) and U.S. Pat. No. D466,224 (granted Nov. 26, 2002 to Oakely).

Despite the advantages of known window well structures, improvements are still being sought. For example, many of the window wells require extensive use of metal thereby consuming an expensive natural resource. Other known window wells may be difficult to manufacture, have an unreasonably high cost or lack adequate reinforcement.

The prior art is thus characterized by several disadvantages that are addressed by the present disclosure. The present disclosure minimizes, and in some aspects eliminates, the above-mentioned failures, and other problems, by utilizing the methods and structural features described herein. The features and advantages of the disclosure will be set forth in the description which follows, and in part will be apparent from the description, or may be learned by the practice of the disclosure without undue experimentation. The features and advantages of the disclosure may be realized and obtained by means of the instruments and combinations particularly pointed out in the appended claims.

BRIEF DESCRIPTION OF THE DRAWINGS

The features and advantages of the disclosure will become apparent from a consideration of the subsequent detailed description presented in connection with the accompanying drawings in which.

DETAILED DESCRIPTION

Figure 1:
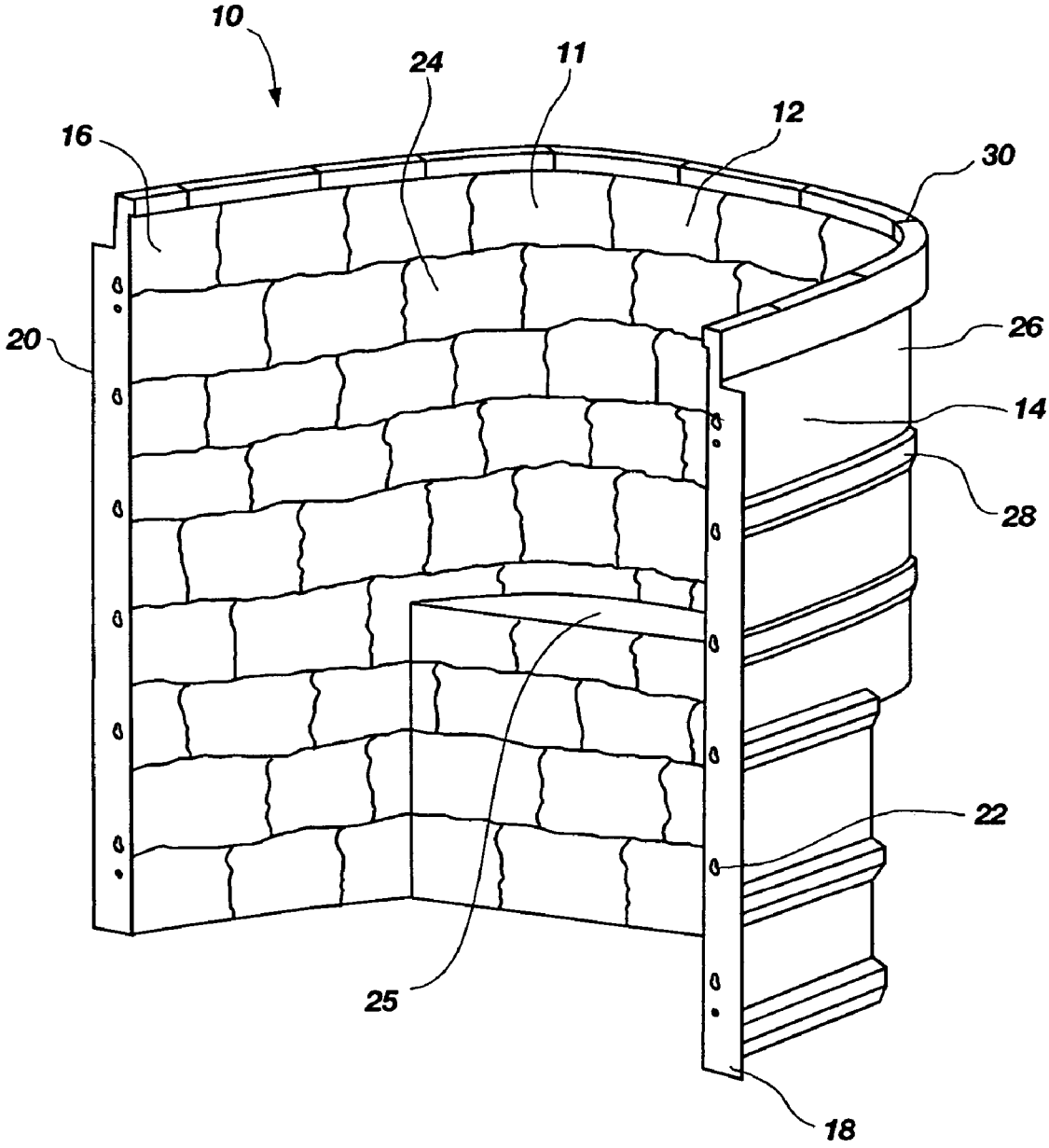
FIG. 1 is a schematic view of a window well structure pursuant to one embodiment of the present disclosure.

For the purposes of promoting an understanding of the principles in accordance with the disclosure, reference will now be made to the embodiments illustrated in the drawings and specific language will be used to describe the same. It will nevertheless be understood that no limitation of the scope of the disclosure is thereby intended. Any alterations and further modifications of the inventive features illustrated herein, and any additional applications of the principles of the disclosure as illustrated herein, which would normally occur to one skilled in the relevant art and having possession of this disclosure, are to be considered within the scope of the disclosure claimed.

It must be noted that, as used in this specification and the appended claims, the singular forms "a," "an," and "the" include plural referents unless the context clearly dictates otherwise. Further, as used herein, the terms "comprising," "including," "containing," "characterized by," and grammatical equivalents thereof are inclusive or open-ended terms that do not exclude additional, unrecited elements or method steps.

Referring now to FIG. 1 of the drawings, there is shown a window well structure 10 pursuant to one embodiment of the present invention. As shown, the window well structure 10 is of unitary design and formed from a composite material. The term "unitary" as used herein shall be construed broadly to mean a homogenous whole or an integrated whole, without a dependence on separate and discrete non-integrated layers. It should be noted, that window well structures pursuant to the present disclosure may be of modular design and may not be entirely formed from a composite material. Generally speaking, composite materials (or composites for short) are materials made from two or more components. One component is often a strong fiber such as fiberglass, quartz, Kevlar™ or carbon fiber that gives the material its tensile strength, while another component (called a matrix) is often a resin such as polyester or epoxy that binds the fibers together and (most often) renders the material stiff and rigid. Some composites use an aggregate instead of, or in addition to, fibers. The term "aggregate" as used herein shall be construed broadly to include any mixture separable by mechanical means. Composite materials also include plastics and other similar type materials.

The window well structure 10 may include a main body 11 having a center wall portion 12 and two opposing side portions 14 and 16. The center wall portion 12 and the two opposing side walls 14 and 16 may be interconnected in an arcuate manner such that the main body 11 may have a U-shape or semicircle shape. The structure 10 may be mounted proximate a below ground window through the use of mounting bolts or the like inserted through fastening members 18 and 20. Mounting holes 22 formed in the fastening members 18 and 20 function to permit the main body 11 to be mechanically secured to a foundation of a building or other structure, such as a home.

The window well structure 10 may include at least one integrated step 25 formed in the main body 11. The step 25 may have many functions, including serving as a means for a person to climb out of the window well. Often times, in the case of an emergency, a person must exit a building or home through the window well. The step 25 facilitates egress for both adults and children. The step 25 may also serve as a platform for plants, decorations, and other items that can be viewed from the window.

The main body 11 may include a front surface 24 and a rear surface 26. The front surface 24 faces the window while backfill abuts against the rear surface 26. The front surface 24 may have a decorative and aesthetically pleasing design formed thereon. The decorative design may simulate a natural substance such as stone, wood or boulders. The decorative design may simulate other substances such as bricks or blocks, or any decorative look desired. The decorative design may also simulate natural landscape scenes such as trees, flowers, vine scenes or any other pleasing scene. The decorative design illustrated in FIG. 1 is meant to simulate the look and texture of stone blocks. The decorative design may be incorporated onto the front surface 24 during the production process. For example, a molding process may be used to form the decorative design in the front surface 24. The term "decorative" as used herein shall be construed broadly to mean a design simulation causing a surface to appear to be something it is not, or any surfacial aesthetic design intended to be visually interesting.

A cap 30 may be disposed on the uppermost portion of the main body 11. The cap 30 may be formed to simulate the appearance of a capstone, to complement the decorative design on the front surface 24 of the main body 11. The cap 30 also serves to protect the main body 11. The cap 30 may be formed by a molding process, or by any other suitable construction or formation process.

Figure 2:
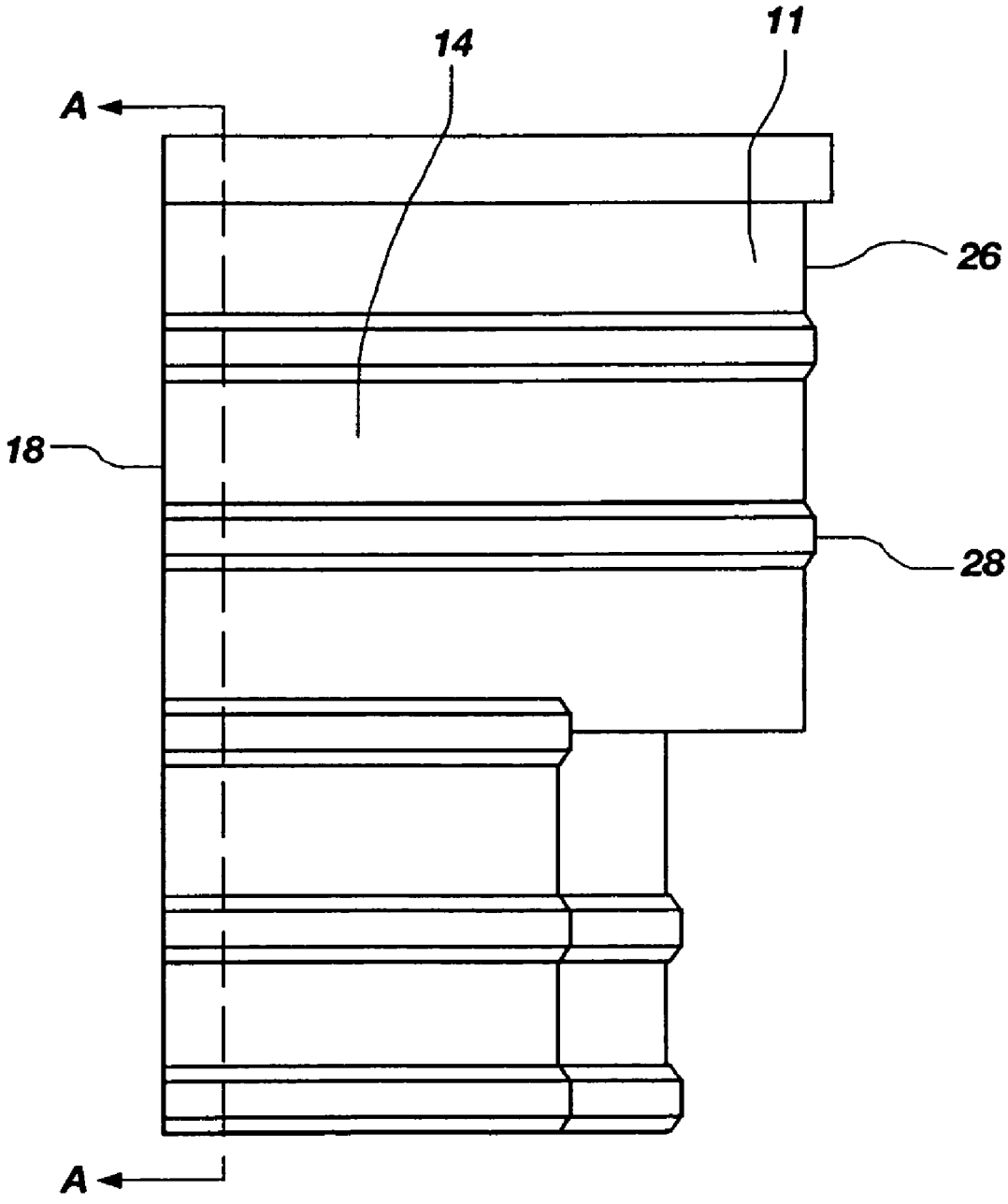
FIG. 2 is a side view of the window well structure illustrated in FIG. 1.

The rear surface 26 of the main body 11 generally does not include a decorative design, since the rear surface 26 is typically covered by backfill after the window well structure 10 is installed. As best seen in FIGS. 1 and 2, disposed on the rear surface 26 are a plurality of support ribs 28. The support ribs 28 provide reinforcement and strength for the main body 11, such that the main body 11 can withstand the forces exerted against it when installed. Such forces may include the settling of the backfill against the main body 11, or even pressure from water soaking through the ground. In some embodiments of the present disclosure, however, the support ribs 28 may be omitted entirely. It should be noted that the number and placement of the ribs 28 may vary as well.

The ribs 28 may extend in a lateral orientation on the rear surface 26 along the entire length of the main body 11, traversing both of the side walls 14 and 16 and the center wall 12. The ribs 28 may therefore have the same U-shape or semicircle shape of the main body 11. The ribs 28 may be vertically spaced on the main body 11 to provide maximum reinforcement for the main body 11. A rib 28 may be located at the lower most portion of the main body 11.

Figure 3:
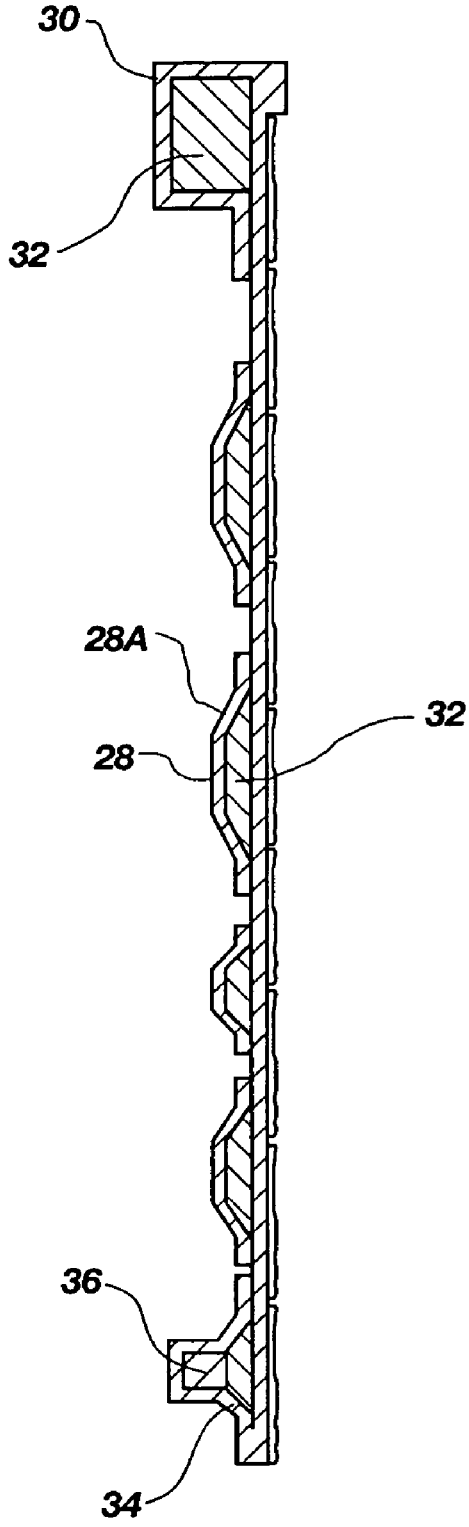
FIG. 3 is a side, cross-sectional view of the window well structure taken along section A-A shown in FIG. 2.

Referring now to FIG. 3, there is shown a cross-sectional view of one of the side walls 14 of the main body 11 taken along the section A-A shown in FIG. 2. Each of the ribs 28 may be formed at least partially of a composite material. The ribs 28 may be co-cured with the main body 11 if the main body 11 is also formed from a composite material. The ribs 28 may be of any shape, including, without restriction, square, circular, rectangular, trapezoidal, or triangular. Each rib 28 may include an upper surface 28A sloping downward and away from the main body 11. The downward-sloping configuration of upper surface 28A allows the backfill to settle, while reducing the vertical load component imposed by the settling backfill against the window well structure 10. This feature of the ribs 28 serves to inhibit the backfill from pulling the window well structure 10 away from its mountings.

The ribs 28 may be formed over a core comprising a filler material 32. The filler material 32 may maintain the ribs 28 in the proper geometry during the curing process. The filler material 32 may include rigid or non-rigid materials. By "non-rigid" is meant materials that in and of themselves provide little or no reinforcement to the main body 11 but are sufficiently suited for serving as a form over which the composite material is shaped. The filler material 32 may also comprise foam, such as polyethylene foam. Foam is advantageous due to its low cost and light weight. Foam also maintains its shape during the curing process, and may be flexible to match the arcuate contour of the main body 11. Not all of the ribs 28 need to extend the entire length of the main body 11. The cap 30 may also include a core filler material 32. Again, the filler material 32 for the cap 30 may be a rigid or non-rigid material similar to that used in the ribs 28. The filler material 32 in the cap 30 may also comprise foam.

A lower most rib 34 may include a block 36. The block 36 serves as a spacer when multiple window well structures 10 are stacked together. The block 36 may be encapsulated by composite material along with the filler material. Multiple blocks 36 may be used.

Figure 4:
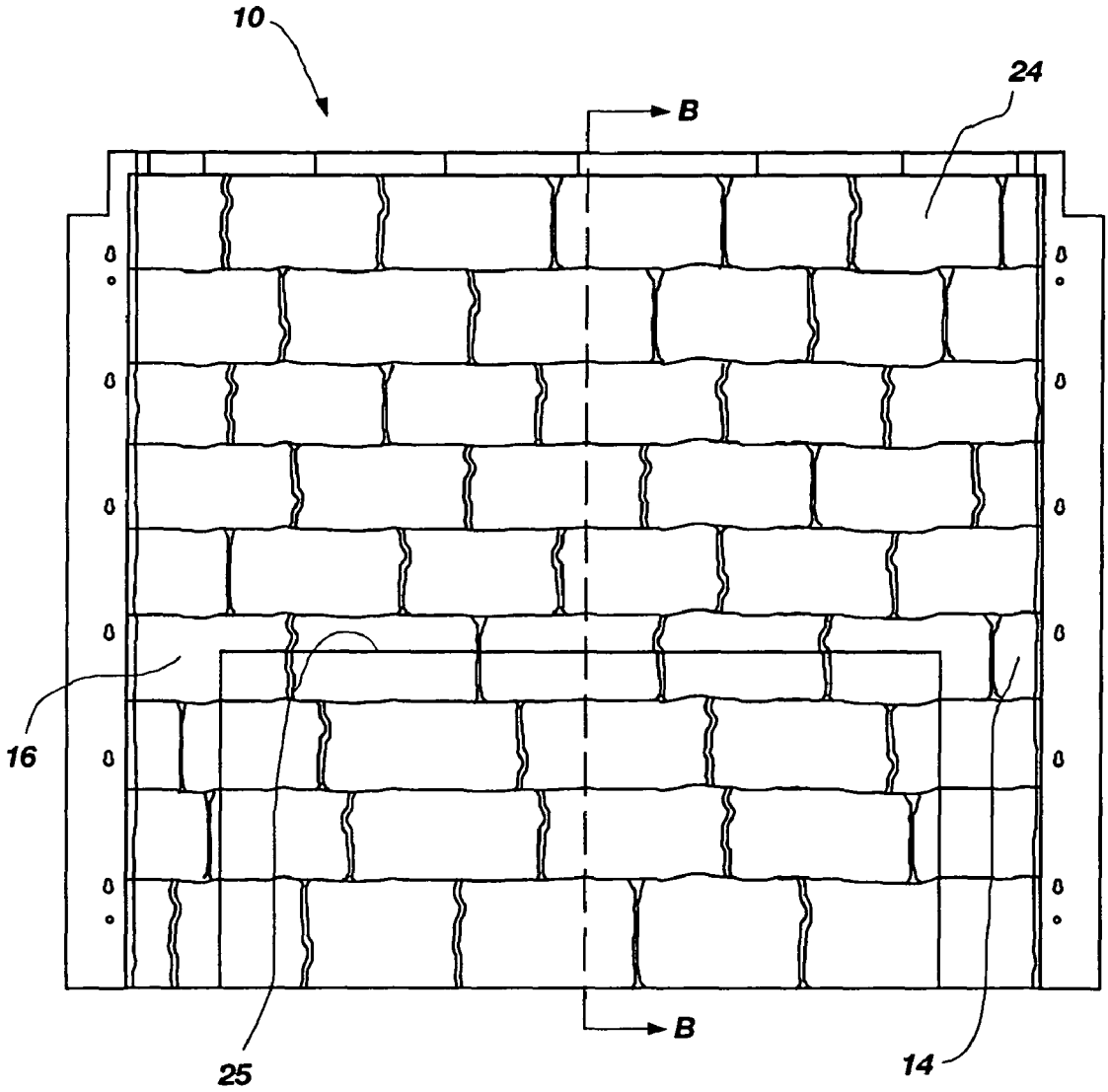
FIG. 4 is a front view of the window well structure illustrated in FIG. 1.

Referring now to FIG. 4, there is shown a front view of the window well structure 10. As can be observed, the decorative design covers the entire front surface 24 of the main body 11, the decorative design being a simulated stone pattern in this embodiment. It will be appreciated however, that the decorative design may, if desired, comprise less than all of the front surface 24 of the main body 11. The step 25 may extend laterally between the sidewalls 14 and 16.

Figure 5:
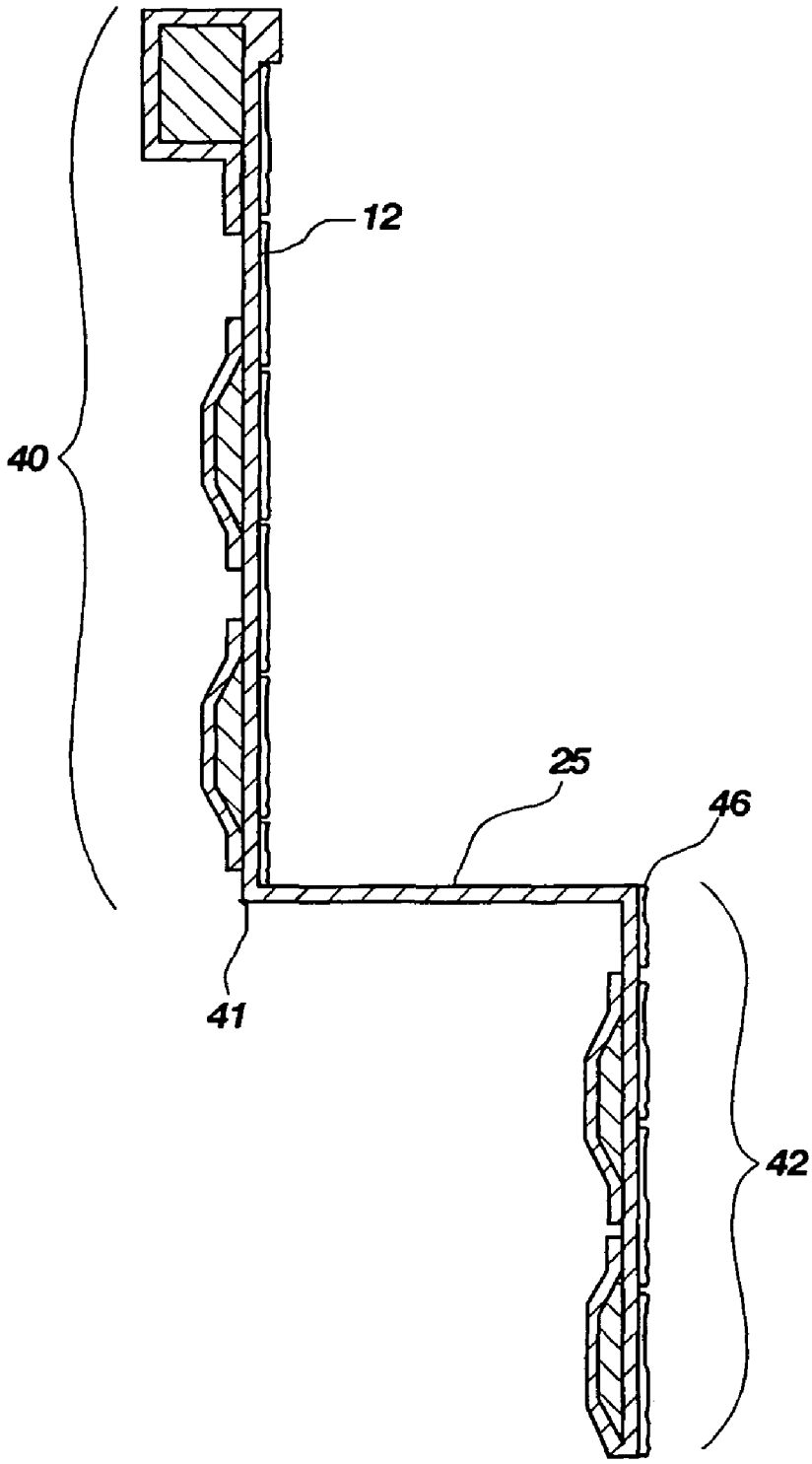
FIG. 5 is a side, cross-sectional view of the window well structure taken along section B-B shown in FIG. 4.

Referring now to FIG. 5, there is shown a scale cross-sectional view of the center wall 12 of the main body 11 taken along the section B-B shown in FIG. 4. The center wall 12 comprises a top portion 40 and a lower portion 42. The step 25 extends from a lower edge 44 of the top portion 40 to an upper edge 46 of the lower portion 42 of the center wall 12.

Figure 6:
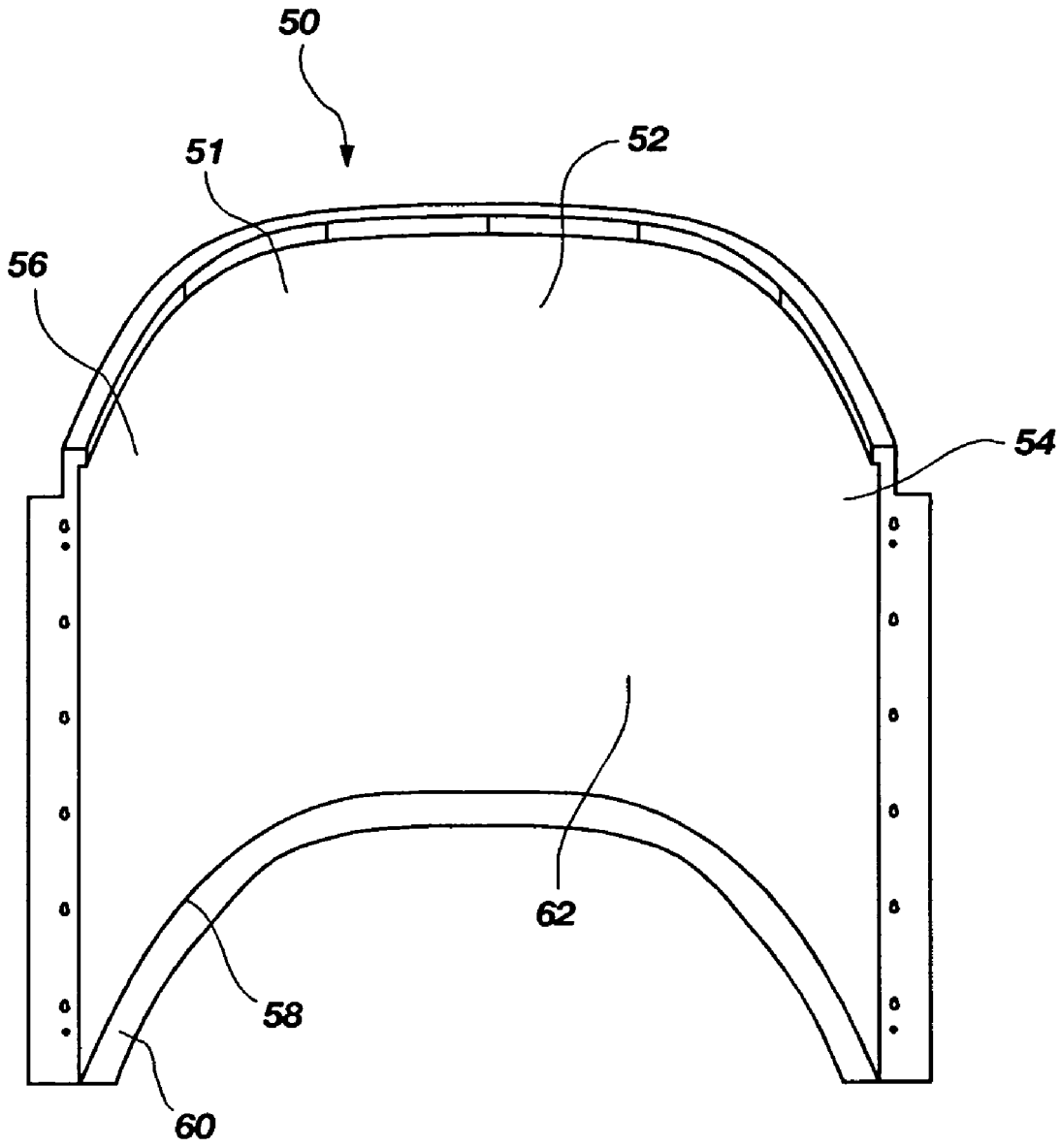
FIG. 6 is front and slightly elevated view of another embodiment of a window well structure pursuant to the present disclosure.

FIG. 6 illustrates a front view of a window well structure 50 pursuant to another embodiment of the present invention. The window well structure 50 includes a main body 51 having a center wall 52 and two opposing side walls 54 and 56. Disposed along a bottom edge 58 of the main body 51 may be an inwardly extending flange 60. The flange 60 may add additional reinforcement to the main body 51. The flange 60 may be formed from a composite material. A front surface 62 of the main body 51 is shown without a decorative design incorporated thereon, and also is shown not having an integrated step such as step 25 of FIG. 1.

Figure 7:
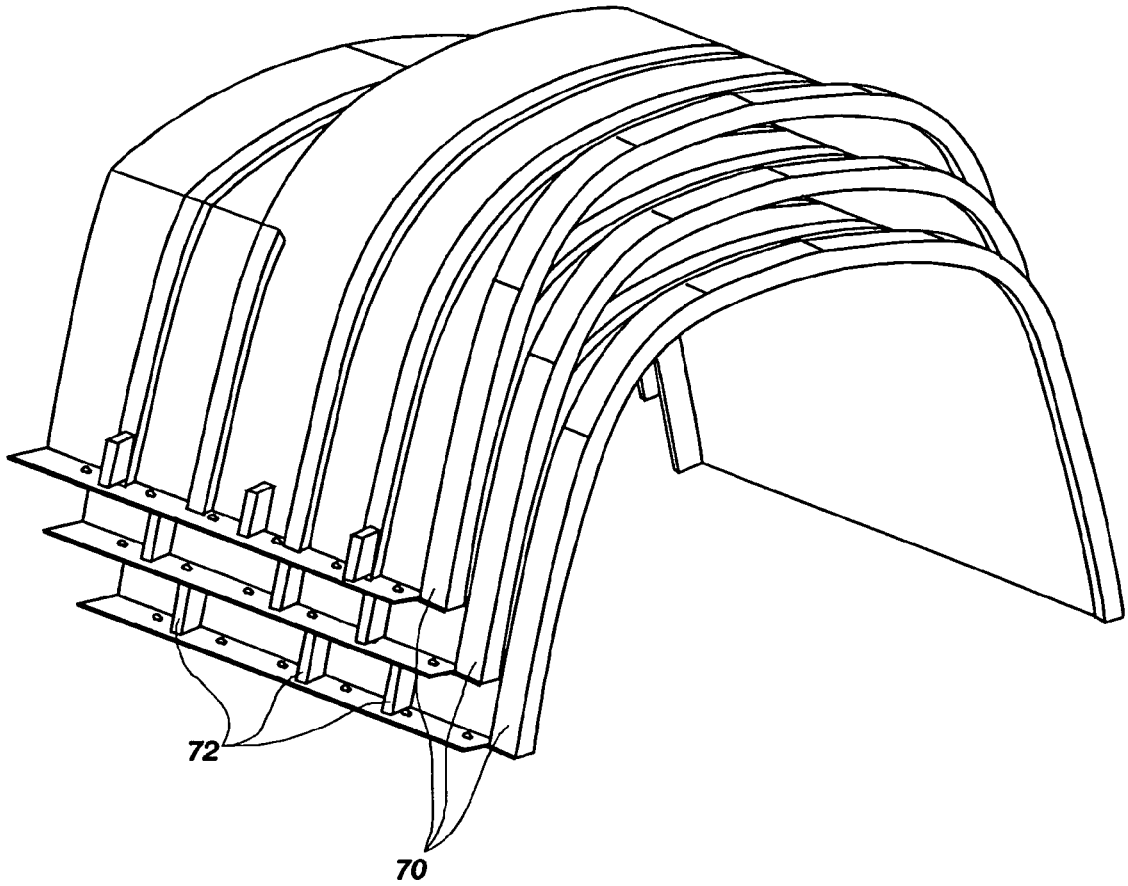
FIG. 7 is a perspective view of multiple window well structures pursuant to the present disclosure stacked one on top of the other.

FIG. 7 illustrates a stacking feature of three window well structures 70 pursuant to another embodiment of the present invention. The window well structures 70 are stacked front to back. Spacing blocks 72 are incorporated into each of the window well structures 70 to prevent damage to any decorative designs that may be present on the window well structures. The spacing blocks 72 may be encapsulated by a composite material.

In one aspect of the present disclosure, a process for making a window well structure comprises:

(A) providing a mold having a decorative design integrated on a molding surface and an integral step formed therein;

(B) placing one or more large sheets of fiberglass molding mat over the entire mold to cover the molding surface leaving extra mat at both the top and the bottom of the mold;

(C) placing an elongated foam body on top of the fiberglass mat(s) at the top of the mold;

(D) folding back the extra mat at the top of the mold such that it covers the foam body;

(F) placing foam ribs on top of the fiberglass mat(s);

(G) placing fiber-mat design strips on top of each foam rib;

(H) placing resin lines and vacuum bags;

(I) evacuating air from the fiber-mat from between a surface of the vacuum bags and a surface of the mold;

(J) injecting resin into the fiber-mat and the molding mat and allowing the resin to cure; and (K) remove the window well structure from the mold.

Those having ordinary skill in the relevant art will appreciate the advantages provided by the features of the present disclosure. For example, it is a feature of the present disclosure to provide a window well structure formed of a composite material. Another feature of the present disclosure is to provide a window well structure having ribs formed at least partially of a composite material. It is a further feature of the present disclosure, in accordance with one aspect thereof, to provide ribs having a core filler material, such as foam. It is another feature of the present disclosure to provide a window well structure with a decorative design on a front surface. It should be understood by those skilled in the art that some, none, or all of the above features may be found in embodiments of the present invention.

In the foregoing Detailed Description, various features of the present disclosure are grouped together in a single embodiment for the purpose of streamlining the disclosure. This method of disclosure is not to be interpreted as reflecting an intention that the claimed disclosure requires more features than are expressly recited in each claim. Rather, as the following claims reflect, inventive aspects lie in less than all features of a single foregoing disclosed embodiment. Thus, the following claims are hereby incorporated into this Detailed Description by this reference, with each claim standing on its own as a separate embodiment of the present disclosure.

It is to be understood that the above-described arrangements are only illustrative of the application of the principles of the present disclosure. Numerous modifications and alternative arrangements may be devised by those skilled in the art without departing from the spirit and scope of the present disclosure and the appended claims are intended to cover such modifications and arrangements. Thus, while the present disclosure has been shown in the drawings and described above with particularity and detail, it will be apparent to those of ordinary skill in the art that numerous modifications, including, but not limited to, variations in size, materials, shape, form, function and manner of operation, assembly and use may be made without departing from the principles and concepts set forth herein.

What is claimed is:

1. A unitary window well structure adapted to be disposed at least partially below grade and adjacent a window in a foundation, said unitary window well structure comprising:

a main body having a center wall portion that includes a top portion and a bottom portion and that is interconnected to two opposing side portions in an arcuate manner, each of the two opposing side portions having a vertical flange extending therefrom, wherein each of the vertically extending flanges further includes at least one spacing block formed thereon, the main body also including a front surface and a rear surface;

an integrated step that is integrally formed into the main body, the integrated step extending inwardly away from the center wall portion and integrally connecting a lower edge of the top portion of the center wall to an upper edge of the lower portion of the center wall, the integrated step being positioned substantially centrally between the two opposing side portions along the center wall;

wherein the integrated step is the only step formed into the unitary window well structure and such that the unitary window well consists of only a single step, with the top portion of the center wall extending upwardly from the lower edge of the window well structure without any defined step therein between, and with the bottom portion of the center wall extending downwardly from the upper edge of the lower portion of the center wall portion to a bottom edge of the unitary window well structure without any defined step therein between; and a molded decorative design simulating stone, brick or wood formed directly into the front surface of the unitary window well structure and without being fully visibly formed into the rear surface of the unitary window well structure.

2. The unitary window well structure of claim 1, wherein the unitary window well structure is composed of a composite material that is comprised of fiberglass.

3. The unitary window well structure of claim 1, wherein the unitary window well structure is composed of a composite material that is comprised of fibers that are bonded together.

4. The unitary window well structure of claim 1, further comprising a cap disposed on an upper portion of the main body and being formed of a composite material and wherein the cap also includes the molded decorative design.

5. The unitary window well structure of claim 4, wherein the cap includes a core formed of a filler material.

6. The unitary window well structure of claim 5, wherein the filler material is a non-rigid material.

7. The unitary window well structure of claim 5, wherein the filler material is foam.

8. The unitary window well structure of claim 1, further comprising a cap formed of a composite material.

9. The unitary window well structure of claim 8, wherein the cap includes a core formed of a filler material.

10. The unitary window well structure of claim 9, wherein the filler material for the core of the cap is a non-rigid foam material.

11. The unitary window well structure of claim 1, wherein the main body is generally U-shaped.

12. The unitary window well structure of claim 1, wherein the unitary window well structure further includes a plurality of support ribs disposed on the back surface of the main body which do not visibly extend through the front surface and so as to avoid interfering with the molded decorative design that is formed into the front surface, and wherein at least one support rib is disposed on the back surface within the bottom portion of the main body that extends directly below the integrated step.

13. The unitary window well structure recited in claim 1, wherein the molded decorative design simulates brick.

14. The unitary window well structure recited in claim 1, wherein the molded decorative design simulates wood.

15. The unitary window well structure recited in claim 1, wherein the molded decorative design simulates stone.

16. A unitary window well structure adapted to be disposed at least partially below grade and adjacent a window in a foundation, said unitary window well structure comprising:

a main body having a center wall portion that includes a top portion and a bottom portion and that is interconnected to two opposing side portions in an arcuate manner, each of the two opposing side portions having a vertical flange extending therefrom, wherein each of the vertically extending flanges further includes at least one spacing block formed thereon, the main body also including a front surface and a rear surface;

an integrated step that is integrally formed into the main body, the integrated step extending inwardly away from the center wall portion and integrally connecting a lower edge of the top portion of the center wall to an upper edge of the lower portion of the center wall, the integrated step being positioned substantially centrally between the two opposing side portions along the center wall;

a molded decorative design simulating stone, brick or wood formed directly into the front surface of the unitary window well structure and without being fully visibly formed into the rear surface of the unitary window well structure; and a plurality of support ribs disposed on the back surface of the main body which do not visibly extend through the front surface and so as to avoid interfering with the molded decorative design that is formed into the front surface.

17. The unitary window well structure of claim 16, wherein at least one support rib is disposed on the back surface within the bottom portion of the main body that extends directly below the integrated step.

18. The unitary window well structure recited in claim 16, wherein the molded decorative design simulates either brick or wood.

19. The unitary window well structure of claim 16, wherein at least one of the support ribs includes a core formed of a filler material.

20. The unitary window well structure of claim 19, wherein the filler material is a non-rigid material.

21. The unitary window well structure of claim 16, further comprising spacing blocks attached to the main body, the spacing blocks operable to create space between the unitary window well structure and another window well structure stacked with the unitary window well structure.

22. The unitary window well structure of claim 16, wherein the main body is formed from a composite material.

23. The unitary window well structure of claim 22, wherein the main body is comprised of fiberglass.

24. The unitary window well structure of claim 22, wherein the main body is comprised of fibers that are bonded together.

25. The unitary window well structure of claim 16, wherein the main body is generally semicircular shaped such that an upper perimeter thereof is characterized by an absence of corners or planar portions.

26. The unitary window well structure of claim 16, wherein the main body and the support ribs are both comprised of fiberglass.

27. The unitary window well structure of claim 16, wherein at least one of the plurality of support ribs comprises an upper surface sloping downward and away from the main body.

28. The unitary window well structure of claim 16, wherein the front step has a front step wall comprising the decorative design and wherein the decorative design simulates stacked and staggered stones.

29. The unitary window well structure of claim 16, wherein the support ribs are disposed in a lateral orientation with respect to the main body.

* * * * *